US011330377B2

(12) United States Patent
Pelzer et al.

(10) Patent No.: US 11,330,377 B2
(45) Date of Patent: May 10, 2022

(54) SYSTEMS AND METHODS FOR FITTING A SOUND PROCESSING ALGORITHM IN A 2D SPACE USING INTERLINKED PARAMETERS

(71) Applicant: Mimi Hearing Technologies GmbH, Berlin (DE)

(72) Inventors: Robert Pelzer, Berlin (DE); Nicholas R. Clark, Royston (GB); Michael Hirsch, Berlin (DE)

(73) Assignee: Mimi Hearing Technologies GmbH, Berlin (DE)

( * ) Notice: Subject to any disclaimer, the term of this patent is extended or adjusted under 35 U.S.C. 154(b) by 0 days.

(21) Appl. No.: 17/203,479

(22) Filed: Mar. 16, 2021

(65) Prior Publication Data

US 2021/0274297 A1 Sep. 2, 2021

Related U.S. Application Data

(63) Continuation-in-part of application No. 16/868,775, filed on May 7, 2020, now Pat. No. 11,122,374, (Continued)

(51) Int. Cl.
*H04R 25/00* (2006.01)

(52) U.S. Cl.
CPC ..... *H04R 25/505* (2013.01); *H04R 25/305* (2013.01); *H04R 25/70* (2013.01)

(58) Field of Classification Search
CPC ..... H04R 3/04; H04R 25/50; H04R 25/70; H04R 2225/81; H04R 2225/83; G06F 3/16; G06F 3/162; G06F 3/165
See application file for complete search history.

(56) References Cited

U.S. PATENT DOCUMENTS 6,840,908 B2 1/2005 Edwards et al.
7,343,021 B2 * 3/2008 Takagi ..... H04R 25/70 381/312

(Continued)

FOREIGN PATENT DOCUMENTS

WO 2016/078709 A1 5/2016

OTHER PUBLICATIONS

Anwar, Muhammad, et al.; "Data mining of audiology patient records: facts influencing the choice of hearing aid type"; Apr. 30, 2012; BMC Medical Informatics and Decision Making; vol. 12 Suppl 1.

*Primary Examiner* — Ryan Robinson
(74) *Attorney, Agent, or Firm* — Polsinelli PC

(57) ABSTRACT

Disclosed are systems and methods for fitting a sound personalization algorithm using a two-dimensional (2D) graphical fitting interface. A calculated set of initial digital signal processing (DSP) parameters are determined for a given sound personalization algorithm, based on a user hearing profile. The initial DSP parameters are outputted to a 2D graphical fitting interface of an audio personalization application, wherein a first axis represents a level of coloration and a second axis represents a level of compression. A user input specifies a first 2D coordinate selected from a coordinate space presented by the 2D graphical fitting interface. A first set of refined DSP parameters is generated to apply a coloration and/or compression adjustment corresponding to the first 2D coordinate. The given sound personalization algorithm is parameterized with the first set of refined DSP parameters.

20 Claims, 16 Drawing Sheets

Related U.S. Application Data which is a continuation of application No. 16/540,345, filed on Aug. 14, 2019, now Pat. No. 10,687,155.

(56) References Cited

U.S. PATENT DOCUMENTS

| | | | | |
|---|---|---|---|---|
| 8,538,033 | B2 | 9/2013 | Wilson | |
| 8,548,179 | B2 | 10/2013 | Nishizaki | |
| 8,917,892 | B2 | 12/2014 | Poe et al. | |
| 8,948,427 | B2 * | 2/2015 | Wessel | H04R 25/70 381/314 |
| 9,060,235 | B2 * | 6/2015 | Yanz | H04R 25/70 |
| 9,124,995 | B2 * | 9/2015 | Burk | H04R 25/70 |
| 9,344,815 | B2 | 5/2016 | Selig et al. | |
| 9,344,817 | B2 | 5/2016 | Eaton et al. | |
| 9,516,438 | B2 | 12/2016 | Andersen et al. | |
| 9,641,943 | B2 | 5/2017 | Sabin | |
| 9,729,982 | B2 * | 8/2017 | Nishizaki | H04R 25/70 |
| 9,832,562 | B2 | 11/2017 | De Vries et al. | |
| 9,977,645 | B2 * | 5/2018 | Herlofsson | H04R 3/04 |
| 10,187,733 | B2 | 1/2019 | Schneider et al. | |
| 10,199,047 | B1 | 2/2019 | Clark | |
| 10,398,360 | B1 | 9/2019 | Clark | |
| 10,455,335 | B1 | 10/2019 | Clark | |
| 10,531,205 | B1 * | 1/2020 | Oesch | H04R 25/554 |
| 10,798,504 | B2 * | 10/2020 | Chalupper | A61N 1/36039 |
| 10,952,649 | B2 * | 3/2021 | Perscheid | G16H 40/63 |
| 2005/0163328 | A1 * | 7/2005 | Colding | H04R 25/70 381/60 |
| 2010/0080398 | A1 | 4/2010 | Waldmann | |
| 2011/0280409 | A1 * | 11/2011 | Michael | H04R 5/04 381/60 |
| 2014/0194775 | A1 | 7/2014 | Van Hasselt et al. | |
| 2015/0125012 | A1 | 5/2015 | Sabin | |
| 2015/0146876 | A1 | 5/2015 | Nishizaki | |
| 2016/0135719 | A1 | 5/2016 | von Kraus et al. | |
| 2017/0257713 | A1 | 9/2017 | Westermann et al. | |
| 2018/0063653 | A1 | 3/2018 | Aschoff | |
| 2018/0132046 | A1 | 5/2018 | Westermann et al. | |
| 2018/0270590 | A1 | 9/2018 | Rountree | |
| 2018/0286137 | A1 | 10/2018 | Anderson et al. | |
| 2019/0045219 | A1 | 2/2019 | Braness et al. | |
| 2019/0116452 | A1 * | 4/2019 | Shi | G06F 3/167 |
| 2019/0231232 | A1 | 8/2019 | Clark et al. | |
| 2019/0320268 | A1 | 10/2019 | Blau et al. | |
| 2019/0392849 | A1 | 12/2019 | Clark | |
| 2020/0029159 | A1 * | 1/2020 | Clark | H03G 9/005 |
| 2021/0326099 | A1 * | 10/2021 | Hirsch | G06F 3/165 |

* cited by examiner

SYSTEMS AND METHODS FOR FITTING A SOUND PROCESSING ALGORITHM IN A 2D SPACE USING INTERLINKED PARAMETERS

CROSS-REFERENCE TO RELATED APPLICATIONS

This application is a continuation-in-part of U.S. patent application Ser. No. 16/868,775 filed May 7, 2020 and entitled "SYSTEMS AND METHODS FOR PROVIDING PERSONALIZED AUDIO REPLAY ON A PLURALITY OF CONSUMER DEVICES", which is a continuation of U.S. patent application Ser. No. 16/540,345 filed Aug. 14, 2019 and entitled "SYSTEMS AND METHODS FOR PROVIDING PERSONALIZED AUDIO REPLAY ON A PLURALITY OF CONSUMER DEVICES", the contents of which are both herein incorporated by reference in their entirety.

FIELD OF INVENTION

This invention relates generally to the field of audio engineering and digital signal processing and more specifically to systems and methods for enabling users to more easily self-fit a sound processing algorithm, for example by perceptually uncoupling fitting parameters on a 2D graphical user interface.

BACKGROUND

Fitting a sound personalization DSP algorithm is typically an automatic process—a user takes a hearing test, a hearing profile is generated, DSP parameters are calculated and then outputted to an algorithm. Although this may objectively improve the listening experience by providing greater richness and clarity to an audio file, the parameterization may not be ideal as the fitting methodology fails to take into account the subjective hearing preferences of the user (such as preference levels for coloration and compression). Moreover, to navigate the tremendous number of variables that comprise a DSP parameter set, such as the ratio, threshold, and gain settings for every DSP subband, would be cumbersome and difficult.

Accordingly, it is an object of this invention to provide improved systems and methods for fitting a sound processing algorithm by first fitting the algorithm with a user's hearing profile, then allowing a user on a two-dimensional (2D) interface to subjectively fit the algorithm through an intuitive process, specifically through the perceptual uncoupling of fitting parameters, which allows a user to more readily navigate DSP parameters on an x- and y-axis.

SUMMARY

The problems and issues faced by conventional solutions will be at least partially solved according to one or more aspects of the present disclosure. Various features according to the disclosure are specified within the independent claims, additional implementations of which will be shown in the dependent claims. The features of the claims can be combined in any technically meaningful way, and the explanations from the following specification as well as features from the figures which show additional embodiments of the invention can be considered.

According to an aspect of the present disclosure, provided are systems and methods for fitting a sound processing algorithm in a two-dimensional space using interlinked parameters.

Unless otherwise defined, all technical terms used herein have the same meaning as commonly understood by one of ordinary skill in the art to which this technology belongs.

The term "sound personalization algorithm", as used herein, is defined as any digital signal processing (DSP) algorithm that processes an audio signal to enhance the clarity of the signal to a listener. The DSP algorithm may be, for example: an equalizer, an audio processing function that works on the subband level of an audio signal, a multiband compressive system, or a non-linear audio processing algorithm.

The term "audio output device", as used herein, is defined as any device that outputs audio, including, but not limited to: mobile phones, computers, televisions, hearing aids, headphones, smart speakers, hearables, and/or speaker systems.

The term "hearing test", as used herein, is any test that evaluates a user's hearing health, more specifically a hearing test administered using any transducer that outputs a sound wave. The test may be a threshold test or a suprathreshold test, including, but not limited to, a psychophysical tuning curve (PTC) test, a masked threshold (MT) test, a pure tone threshold (PTT) test, and a cross-frequency simultaneous masking (xF-SM) test.

The term "coloration", as used herein, refers to the power spectrum of an audio signal. For instance, white noise has a flat frequency spectrum when plotted as a linear function of frequency.

The term "compression", as used herein, refers to dynamic range compression, an audio signal processing that reduces the signal level of loud sounds or amplifies quiet sounds.

One or more aspects described herein with respect to methods of the present disclosure may be applied in a same or similar way to an apparatus and/or system having at least one processor and at least one memory to store programming instructions or computer program code and data, the at least one memory and the computer program code configured to, with the at least one processor, cause the apparatus at least to perform the above functions. Alternatively, or additionally, the above apparatus may be implemented by circuitry.

One or more aspects of the present disclosure may be provided by a computer program comprising instructions for causing an apparatus to perform any one or more of the presently disclosed methods. One or more aspects of the present disclosure may be provided by a computer readable medium comprising program instructions for causing an apparatus to perform any one or more of the presently disclosed methods. One or more aspects of the present disclosure may be provided by a non-transitory computer readable medium, comprising program instructions stored thereon for performing any one or more of the presently disclosed methods.

Implementations of an apparatus of the present disclosure may include, but are not limited to, using one or more processors, one or more application specific integrated circuits (ASICs) and/or one or more field programmable gate arrays (FPGAs). Implementations of the apparatus may also include using other conventional and/or customized hardware such as software programmable processors.

It will be appreciated that method steps and apparatus features may be interchanged in many ways. In particular, the details of the disclosed apparatus can be implemented as a method, as the skilled person will appreciate.

Other and further embodiments of the present disclosure will become apparent during the course of the following discussion and by reference to the accompanying drawings.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof, which are illustrated in the appended drawings. Understand that these drawings depict only example embodiments of the disclosure and are not therefore to be considered to be limiting of its scope, the principles herein are described and explained with additional specificity and detail through the use of the accompanying drawings in which.

DETAILED DESCRIPTION

Figure 1:
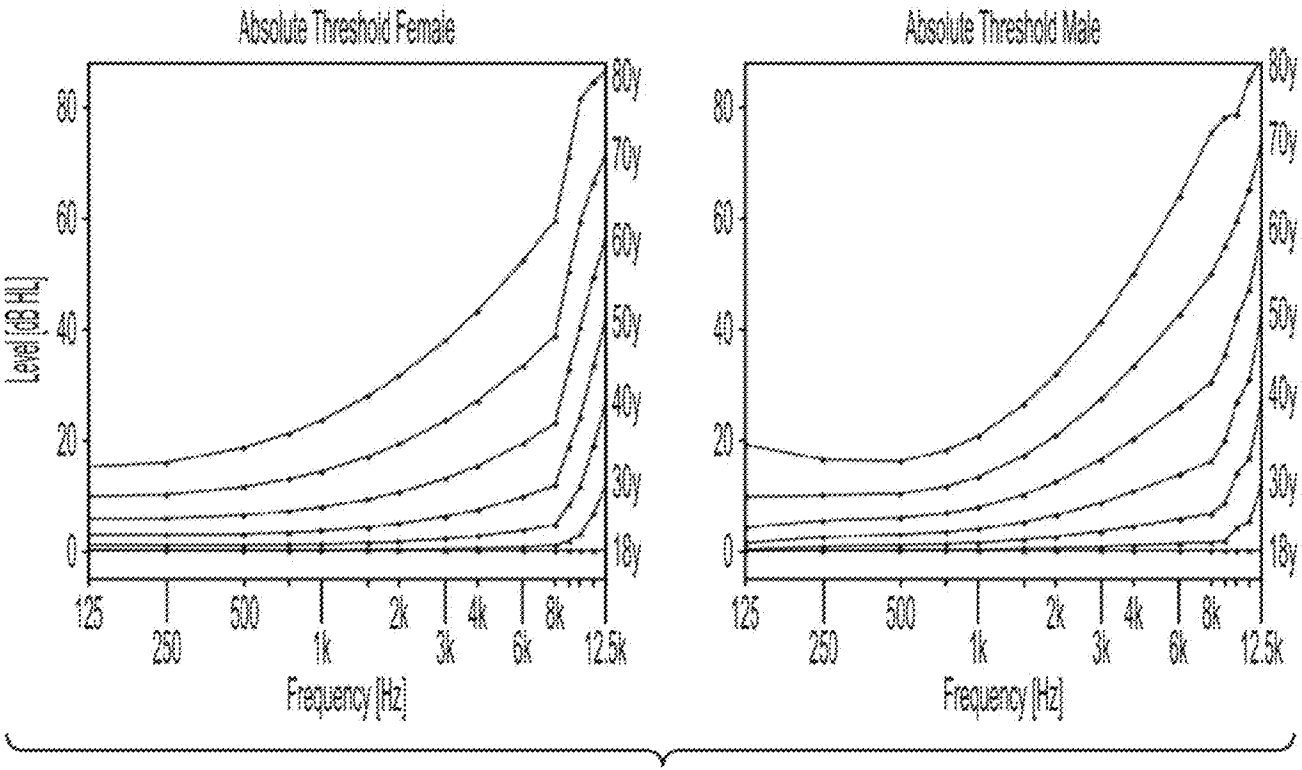
FIG. 1 illustrates graphs showing the deterioration of human audiograms with age.

Various example embodiments of the disclosure are discussed in detail below. While specific implementations are discussed, it should be understood that these are described for illustration purposes only. A person skilled in the relevant art will recognize that other components and configurations may be used without parting from the spirit and scope of the disclosure.

Thus, the following description and drawings are illustrative and are not to be construed as limiting the scope of the embodiments described herein. Numerous specific details are described to provide a thorough understanding of the disclosure. However, in certain instances, well-known or conventional details are not described in order to avoid obscuring the description. References to one or an embodiment in the present disclosure can be references to the same embodiment or any embodiment; and, such references mean at least one of the embodiments.

Reference to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others.

The terms used in this specification generally have their ordinary meanings in the art, within the context of the disclosure, and in the specific context where each term is used. Alternative language and synonyms may be used for any one or more of the terms discussed herein, and no special significance should be placed upon whether or not a term is elaborated or discussed herein. In some cases, synonyms for certain terms are provided. A recital of one or more synonyms does not exclude the use of other synonyms. The use of examples anywhere in this specification including examples of any terms discussed herein is illustrative only and is not intended to further limit the scope and meaning of the disclosure or of any example term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, technical and scientific terms used herein have the meaning as commonly understood by one of ordinary skill in the art to which this disclosure pertains. In the case of conflict, the present document, including definitions will control.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It should be further noted that the description and drawings merely illustrate the principles of the proposed device. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed device. Furthermore, all statements herein providing principles, aspects, and embodiments of the invention, as well as specific examples thereof, are intended to encompass equivalents thereof.

Figure 2:
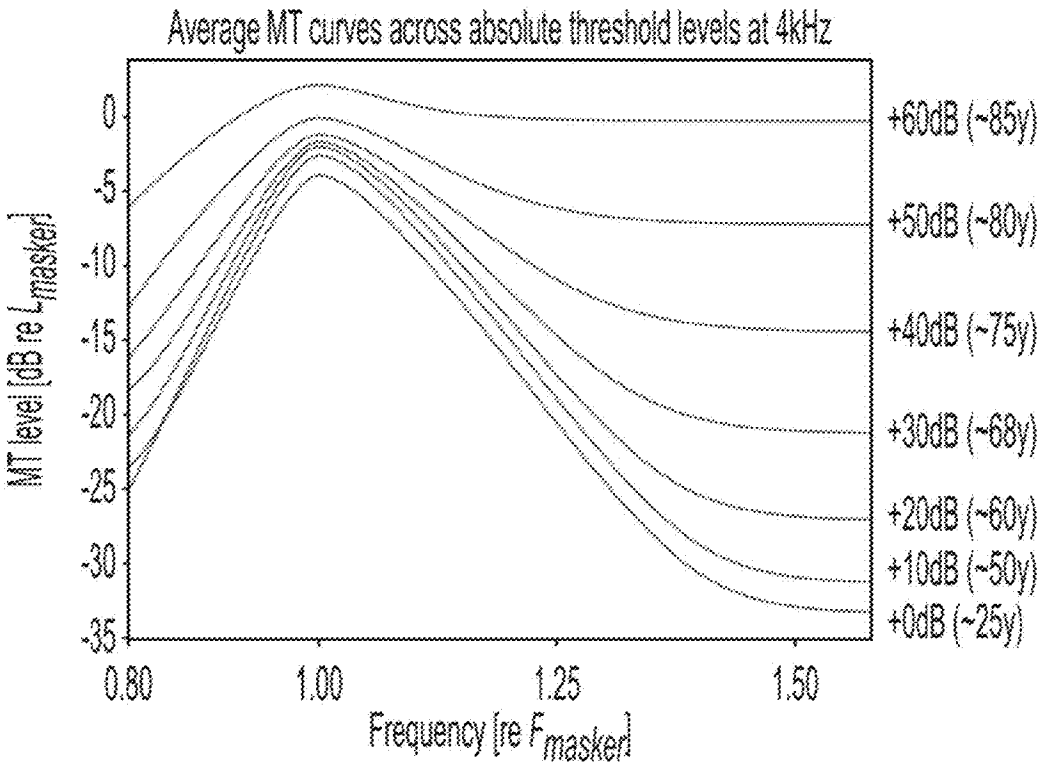
FIG. 2 illustrates a graph showing the deterioration of masking thresholds with age.

The disclosure turns now to FIGS. 1-2, which underscore the importance of sound personalization, for example by illustrating the deterioration of a listener's hearing ability over time. Past the age of 20 years old, humans begin to lose their ability to hear higher frequencies, as illustrated by FIG. 1 (albeit above the spectrum of human voice). This steadily becomes worse with age as noticeable declines within the speech frequency spectrum are apparent around the age of 50 or 60. However, these pure tone audiometry findings mask a more complex problem as the human ability to understand speech may decline much earlier. Although hearing loss typically begins at higher frequencies, listeners who are aware that they have hearing loss do not typically complain about the absence of high frequency sounds. Instead, they report difficulties listening in a noisy environment and in hearing out the details in a complex mixture of sounds, such as in a telephone call. In essence, off-frequency sounds more readily mask a frequency of interest for hearing impaired individuals—conversation that was once clear and rich in detail becomes muddled. As hearing deteriorates, the signal-conditioning capabilities of the ear begin to break down, and thus hearing-impaired listeners need to expend more mental effort to make sense of sounds of interest in complex acoustic scenes (or miss the information entirely). A raised threshold in an audiogram is not merely a reduction in aural sensitivity, but a result of the malfunction of some deeper processes within the auditory system that have implications beyond the detection of faint sounds.

To this extent, FIG. 2 illustrates key, discernable age trends in suprathreshold hearing. Through the collection of large datasets, key age trends can be ascertained, allowing for the accurate parameterization of personalization DSP algorithms. In a multiband compressive system, for example, the threshold and ratio values of each sub-band signal dynamic range compressor (DRC) can be modified to reduce problematic areas of frequency masking, while post-compression sub-band signal gain can be further applied in the relevant areas. Masked threshold curves depicted in FIG. 2 represent a similar paradigm for measuring masked threshold. A narrow band of noise, in this instance around 4 kHz, is fixed while a probe tone sweeps from 50% of the noise band center frequency to 150% of the noise band center frequency. Again, key age trends can be ascertained from the collection of large MT datasets.

Multiband dynamic processors are typically used to improve hearing impairments. In the fitting of a DSP algorithm based on a user's hearing thresholds usually, there are many parameters that can be altered, the combination of which lead to a desired outcome. In a system with a multiband dynamic range compressor, these adjustable parameters usually at least consist of compression thresholds for each band which determine at which audio level the compressor becomes active and compression ratios, which determine how strong the compressor reacts. Compression is applied to attenuate parts of the audio signal which exceeds certain levels to then lift lower parts of the signal via amplification. This is achieved via a gain stage in which a gain level can be added to each band.

According to aspects of the present disclosure, a two-dimensional (2D) space offers the opportunity to disentangle perceptual dimensions of sound to allow more flexibility during a fine-tuning fitting step, such as might be performed by or for a user of an audio output device (see, e.g., the example 2D interface of FIG. 11, which will be discussed in greater depth below). On the diagonal of a 2D space, fitting strength can be fine-tuned with interlinked gain and compression parameters according to an underlying fitting strategy. For a listener with high frequency hearing impairment, moving on the diagonal means that the signal encounters a coloration change due a treble boost whilst also becoming more compressed. In some embodiments, to disentangle compressiveness and gain changes from a general fitting rule or underlying fitting strategy, the perceptual dimensions can also be changed independently, e.g., such that it is possible to move only upwards on the X-axis or sideways on the Y-axis. In some embodiments, the axes as described herein may be switched without departing from the scope of the present disclosure.

Figure 3:
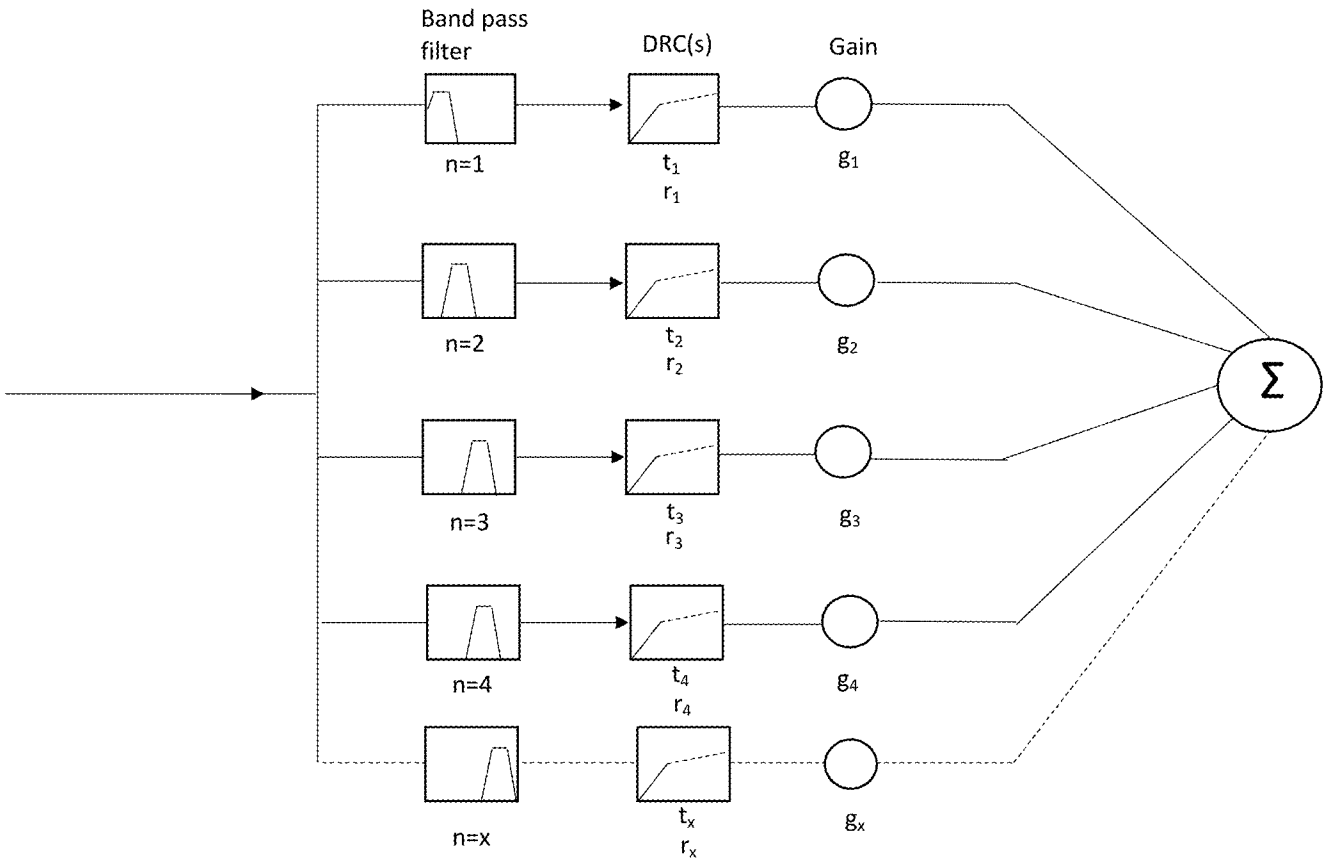
FIG. 3 illustrates an exemplary multiband dynamics processor.

FIG. 3 depicts an example of a multiband dynamics processor featuring a single feed-forward compressor and gain function in each subband. For a given threshold t, ratio r, gain g, and input I, the output O for this multiband dynamics processor can be calculated as:

$$O=t+(I-t)*r+g$$

In the context of providing a 2D fitting interface (such as the example 2D interface seen in FIGS. 11 and/or 12), ratio and gain values can be adjusted as the user scrolls through the two-dimensional fitting interface, such that output remains constant. In some embodiments, the adjustment can be made in real-time, i.e., dynamic adjustments made as the user moves or slides their finger to navigate between various (x, y) coordinates of the 2D interface. In some embodiments, the adjustment can be made after determining or receiving an indication that the user has finalized their selection of an adjustment using the 2D interface, i.e., adjustment is made once the user removes their finger after touching or otherwise indicating a particular (x, y) coordinate of the 2D interface.

Figure 4:
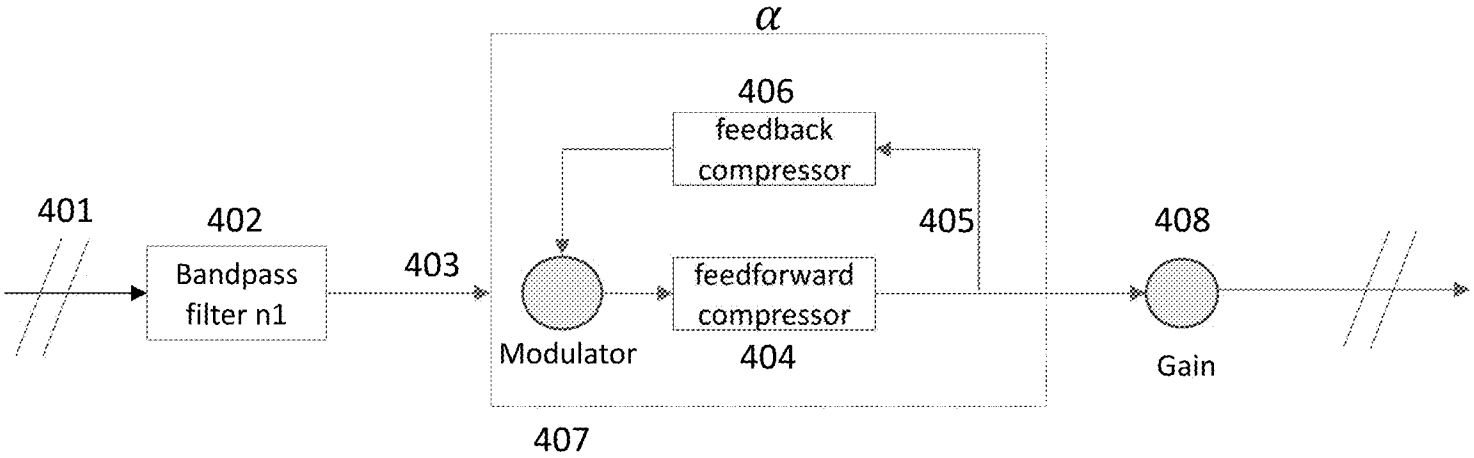
FIG. 4 illustrates an exemplary DSP subband with a feedforward-feedback design.
Figure 5:
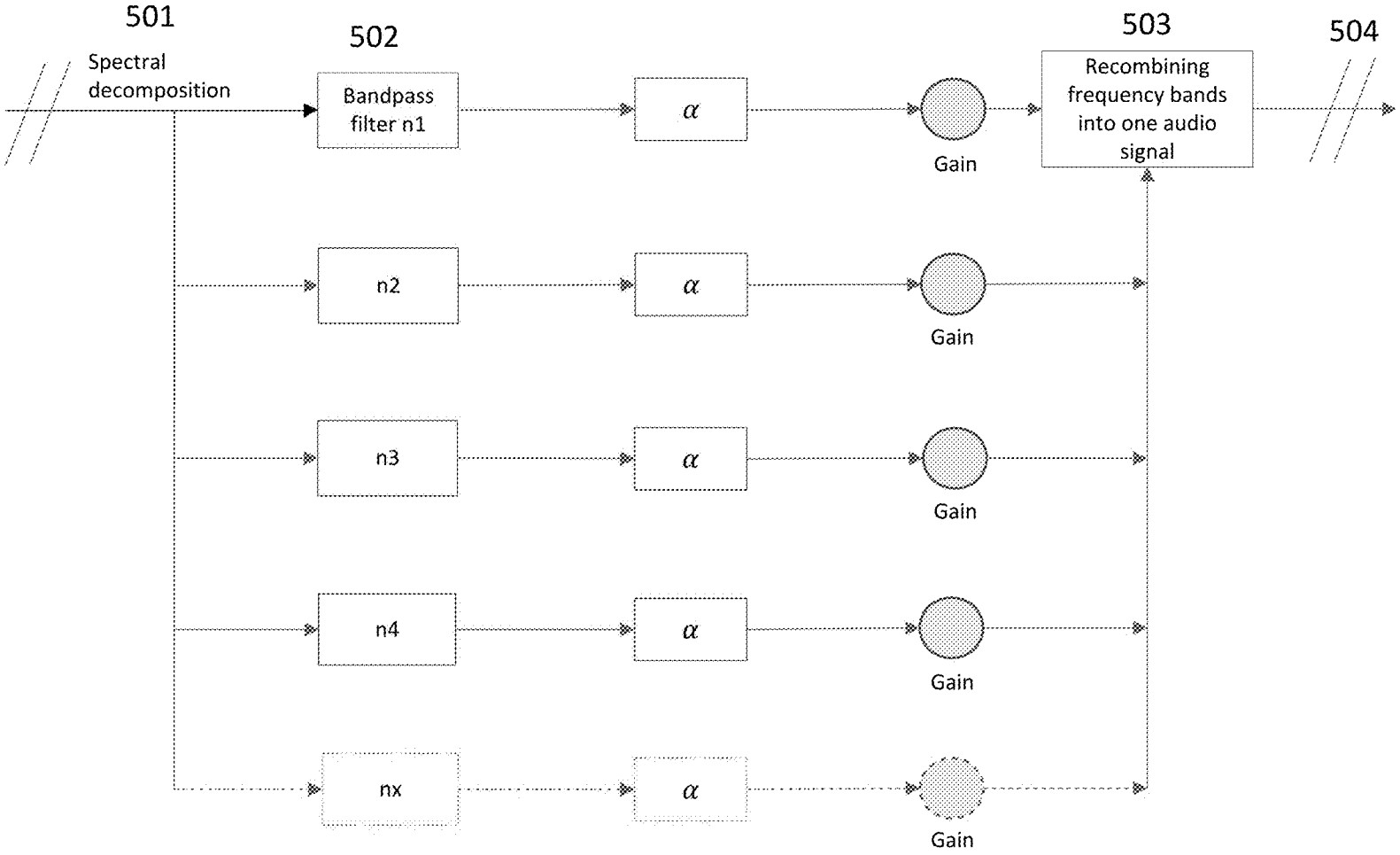
FIG. 5 illustrates an exemplary multiband dynamics processor bearing the unique subband design of FIG. 4.

A more complex multiband dynamics processor than that of FIG. 3 is shown in FIGS. 4 and 5, illustrating a scenario in which a dynamic threshold compressor is featured on each subband. More particularly, FIG. 5 depicts an example architecture diagram of a multiband dynamics processor having subbands $n_1$ through $n_x$. At 501, an input signal undergoes spectral decomposition into the subbands $n_1$ through $n_x$. Each subband is then provided to a corresponding bandpass filter 502, and then passed to a processing stage indicated as 'α'. FIG. 4 provides a detailed view of a single given subband (depicted is subband $n_1$) and the processing stage α. As shown here, processing stage α comprises a modulator 407, a feed-forward compressor 404, and a feed-back compressor 406. Additional details of an example complex multiband dynamics processor can be found in commonly owned U.S. Pat. No. 10,199,047, the contents of which are hereby incorporated by reference in entirety.

Although this more complex multiband dynamics processor offers a number of benefits, it can potentially create a much less intuitive parameter space for some users to navigate, as there are more variables that may interact simultaneously and/or in an opaque manner. Accordingly, it can be even further desirable to provide systems and methods for perceptual disentanglement of compression and coloration in order to facilitate fitting with respect to complex processing schemes.

The formula for calculating the output for this multiband dynamics processor can be calculated as:

$$O=[[(1-FF_r)\cdot FF_t+I\cdot FF_r+FB_t\cdot FB_c\cdot FF_r]/(1+FB_c\cdot FF_r)]+g$$

Where O=output of multiband dynamics processor; I=input 401; g=gain 408; $FB_c$=feed-back compressor 406 factor;

$FB_t$=feed-back compressor 406 threshold; $FF_r$=feed-forward compressor 404 ratio; $FF_t$=feed-forward compressor 404 threshold. Here again, as described above with respect to the multiband dynamics processor of the example of FIG. 3, in the context of providing a 2D fitting interface of the present disclosure, compression ratios and gain values can be adjusted as the user scrolls through the two-dimensional fitting interface such that output levels remain constant.

Figure 6:
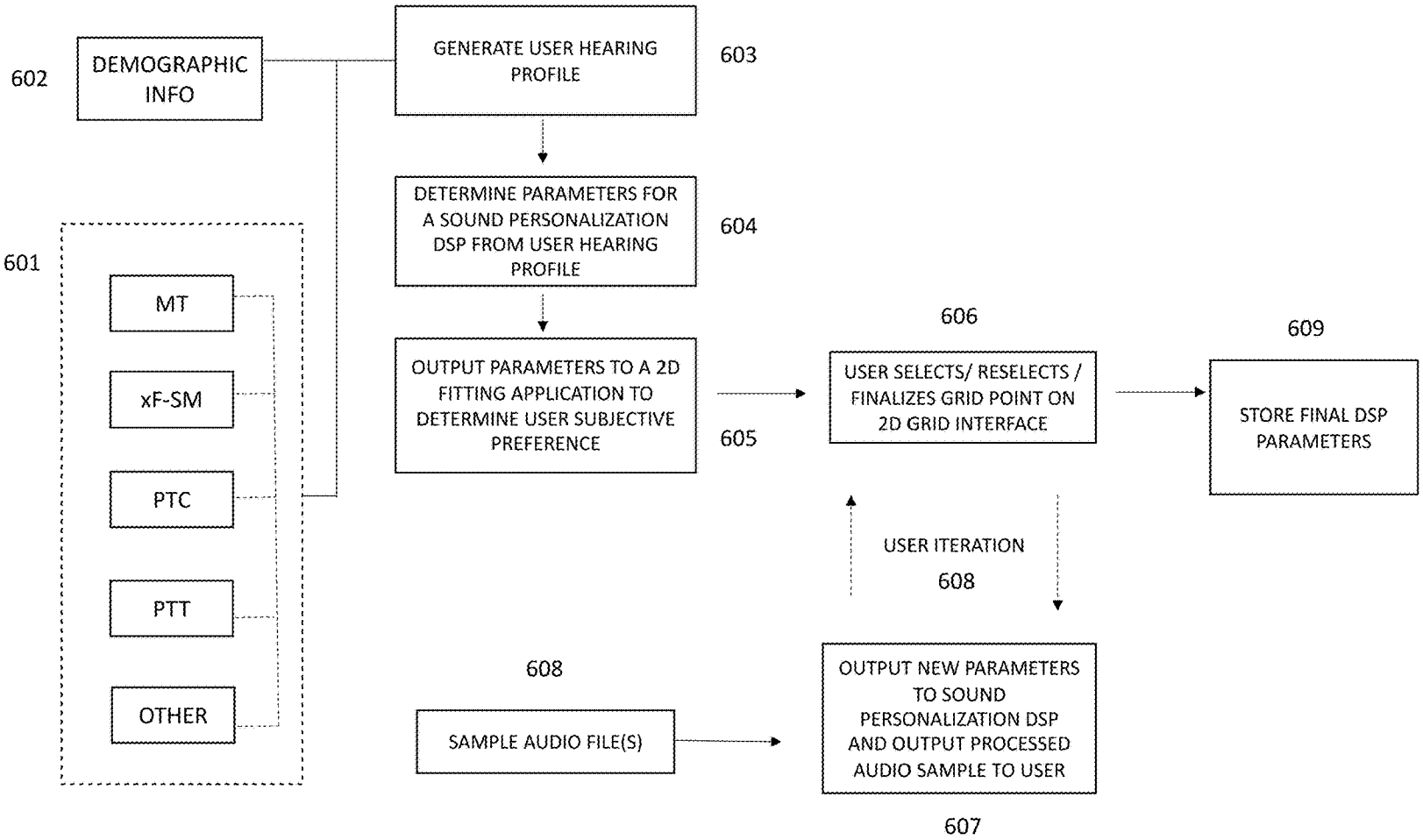
FIG. 6 illustrates an exemplary method of 2D fitting.

FIG. 6 illustrates an embodiment of the present disclosure in which a user's hearing profile first parameterizes a sound enhancement algorithm (herein after called objective parameterization) that then a user can subjectively fit. First, a hearing test is conducted 601 on an audio output device to generate a user hearing profile 603. Alternatively, a user may just input their demographic information 602, which would then input a representative hearing profile 603. The hearing test may be provided by one or more hearing test options, including but not limited to: a masked threshold test (MT test), a cross frequency simultaneous masking test (xF-SM), a psychophysical tuning curve test (PTC test), a pure tone threshold test (PTT test), or other suprathreshold tests. Next, the user hearing profile 603 is used to calculate 604 at least one set of objective DSP parameters for at least one sound enhancement algorithm.

Objective parameters may be calculated by any number of methods. For example, DSP parameters in a multiband dynamic processor may be calculated by optimizing perceptually relevant information (e.g., perceptual entropy), as disclosed in commonly owned U.S. Pat. No. 10,455,335. Alternatively, a user's masking contour curve in relation to a target masking curve may be used to determine DSP parameters, as disclosed in commonly owned U.S. Pat. No. 10,398,360. Other parameterization processes commonly known in the art may also be used to calculate objective parameters based off user-generated threshold and suprathreshold information without departing from the scope of the present disclosure. For instance, common fitting techniques for linear and non-linear DSP may be employed. Well known procedures for linear hearing aid algorithms include POGO, NAL, and DSL (see, e.g., H. Dillon, Hearing Aids, $2^{nd}$ Edition, Boomerang Press, 2012).

Objective DSP parameter sets may be also calculated indirectly from a user hearing test based on preexisting entries or anchor points in a server database. An anchor point comprises a typical hearing profile constructed based at least in part on demographic information, such as age and sex, in which DSP parameter sets are calculated and stored on the server to serve as reference markers. Indirect calculation of DSP parameter sets bypasses direct parameter sets calculation by finding the closest matching hearing profile(s) and importing (or interpolating) those values for the user.

Figures 7A, 7B, 7C:
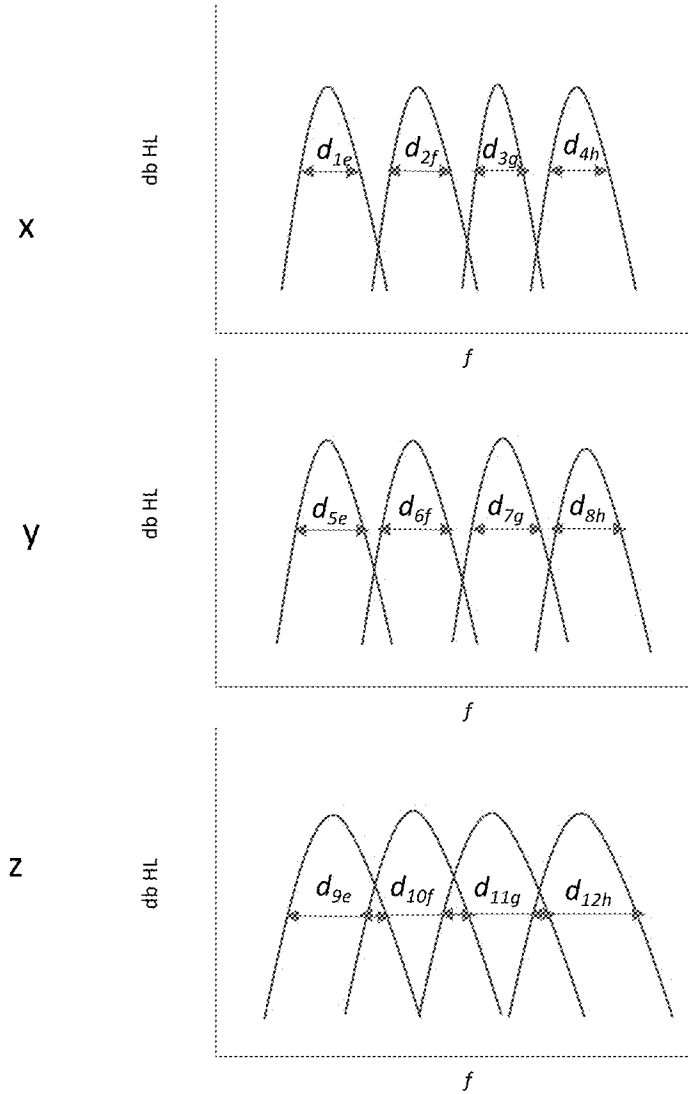
FIGS. 7A-C conceptually illustrate masked threshold curve widths for three different users, which can be used for best fit and/or nearest fit calculations.

FIGS. 7A-C illustrate three conceptual user masked threshold (MT) curves for users x, y, and z, respectively. The MT curves are centered at frequencies a-d, each with curve width d, which may be used to as a metric to measure the similarity between user hearing data. For instance, a root mean square difference calculation may be used to determine if user y's hearing data is more similar to user x's or user z's, e.g. by calculating:

$$(\sqrt{(d5q-d1a)^2+(d6b-d2b)^2\ldots}<\sqrt{(d5a-d9a)^2+(d6b-d10b)^2\ldots})$$

Figure 8:
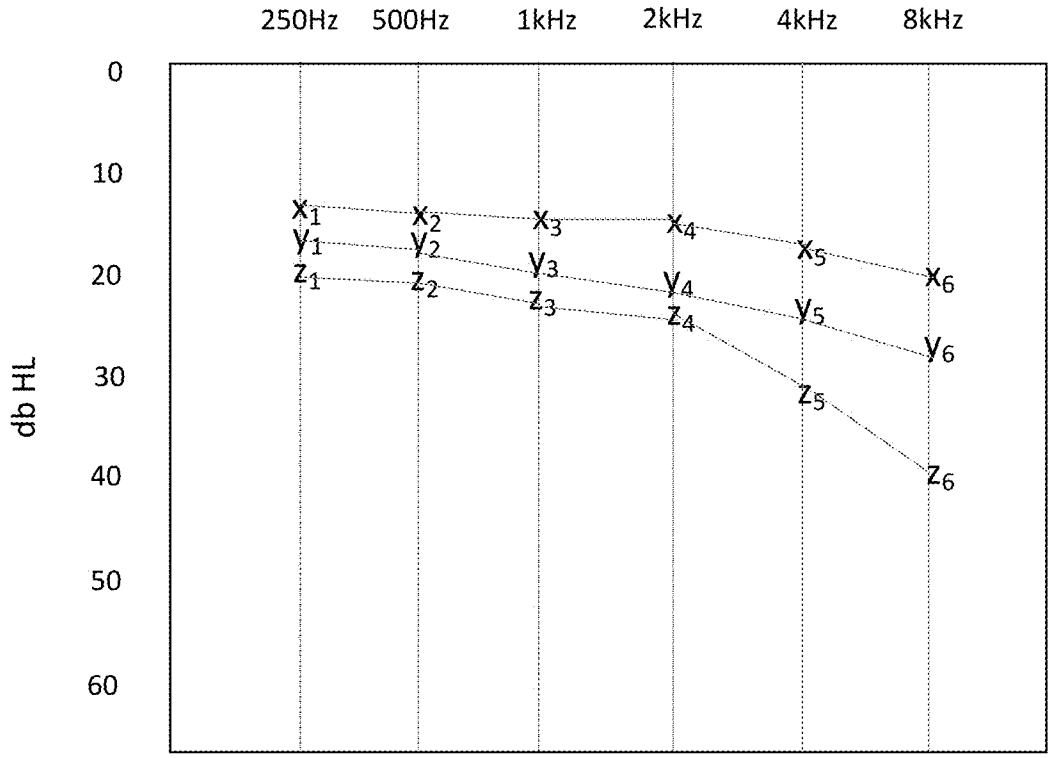
FIG. 8 conceptually illustrates audiogram plots for three different users x, y and z, data points which can be used for best fit and/or nearest fit calculations.

FIG. 8 illustrates three conceptual audiograms of users x, y and z, each with pure tone threshold values 1-5. Similar to above, a root mean square difference measurement may also be used to determine, for example, if user y's hearing data is more similar to user x's than user z's, e.g., by calculating:

$$(\sqrt{(y1-x1)^2+(y2-x2)^2\ldots}<\sqrt{(y1-z1)^2+(y2-z2)^2\ldots})$$

As would be appreciated by one of ordinary skill in the art, other methods may be used to quantify similarity amongst user hearing profile graphs, where the other methods can include, but are not limited to, methods such as a Euclidean distance measurements, e.g. ((y1−x1)+(y2−x2) . . . >(y1−x1)+(y2−x2)) . . . or other statistical methods known in the art. For indirect DSP parameter set calculation, then, the closest matching hearing profile(s) between a user and other preexisting database entries or anchor points can then be used.

Figure 9:
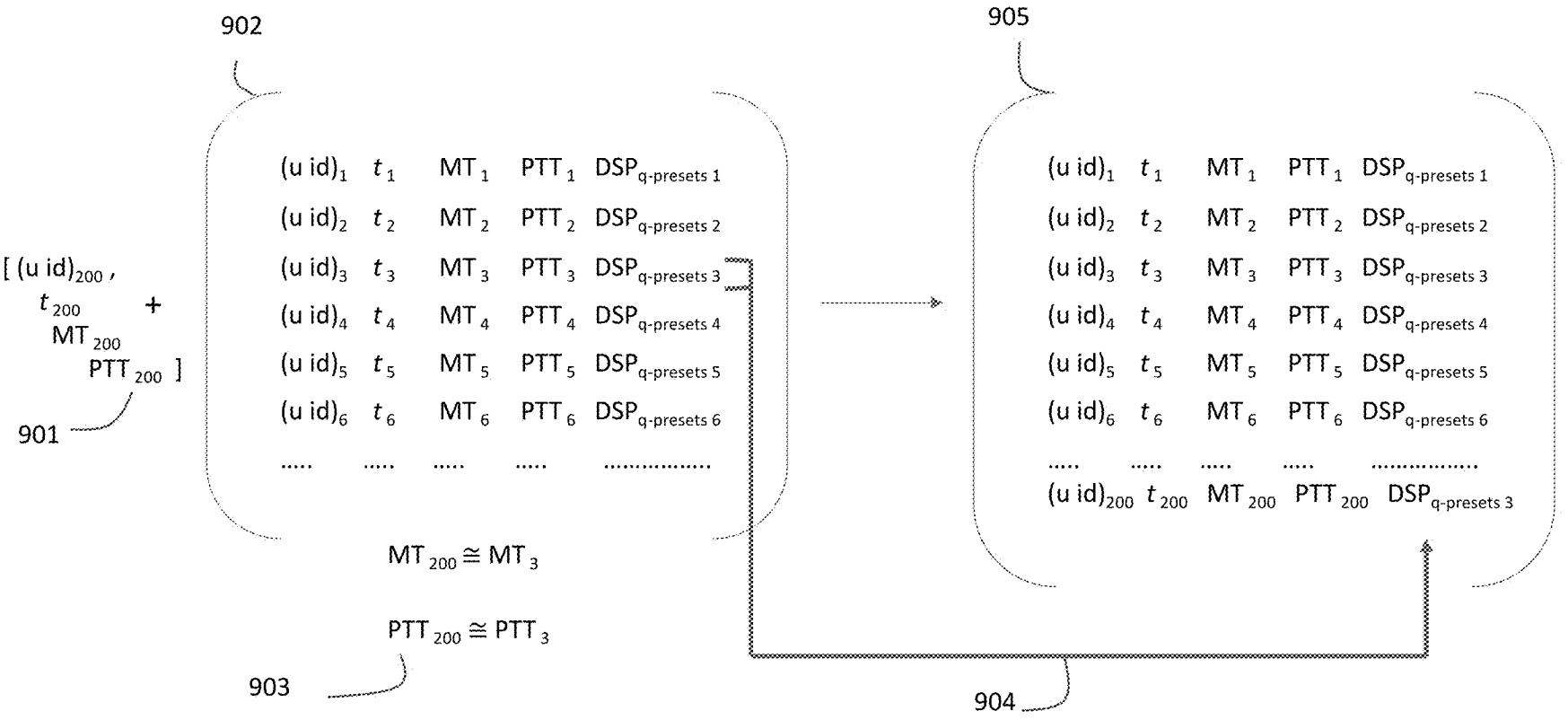
FIG. 9 illustrates a method for parameter calculation using a best-fit approach.
Figure 14:
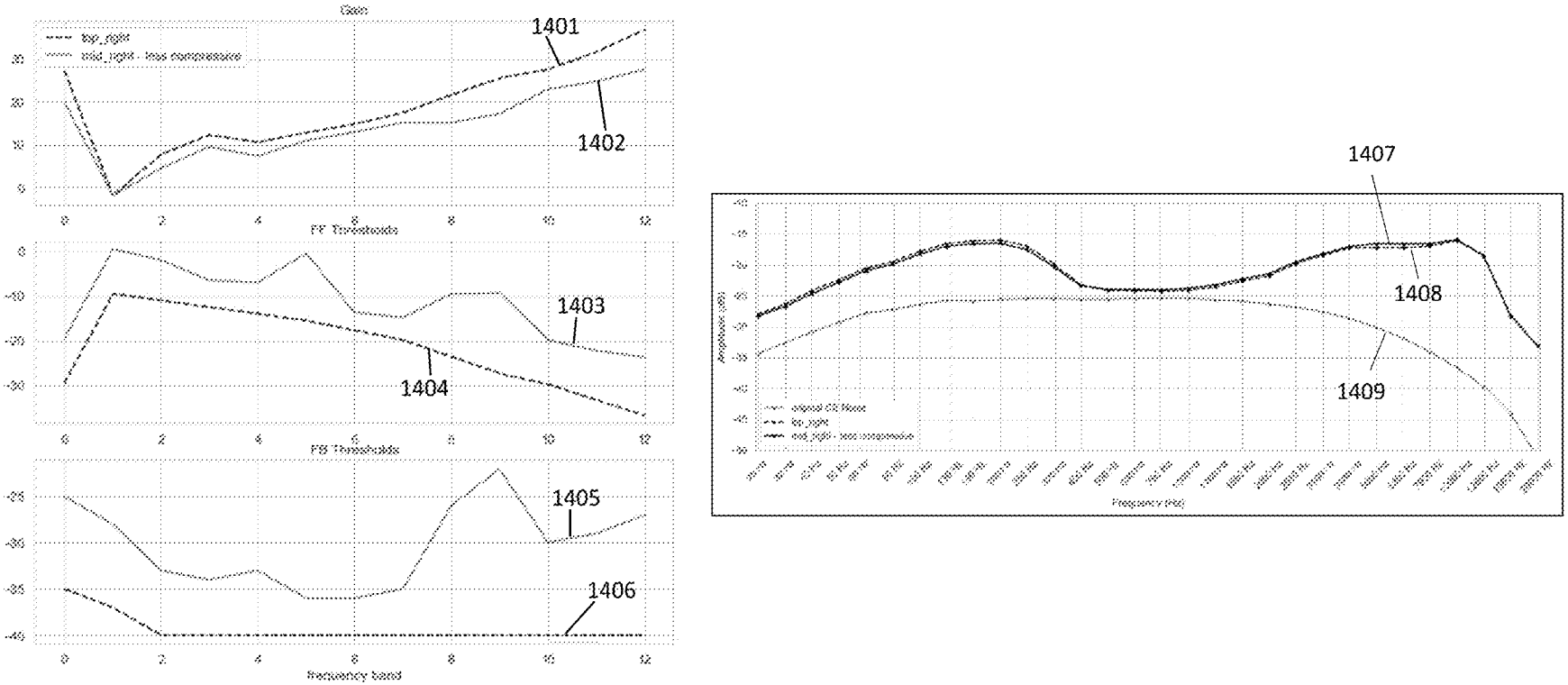
FIG. 14 illustrates an example of the perceptual disentanglement of coloration and compression achieved according to aspects of the present disclosure.

FIG. 9 illustrates an exemplary embodiment for calculating sound enhancement parameter sets for a given algorithm based on preexisting entries and/or anchor points. Here, server database entries 902 are surveyed to find the best fit(s) with user hearing data input 901, represented as $MT_{200}$ and $PTT_{200}$ for $(u_id)_{200}$. This may be performed by the statistical techniques illustrated in FIGS. 7 and 8. In the example of FIG. 14, $(u_id)_{200}$ hearing data best matches $MT_3$ and $PTT_3$ data 1403. To this extent, $(u_id)_3$ associated parameter sets, $[DSP_{q\text{-}param\ 3}]$, are then used for the $(u_id)_{200}$ parameter set entry, illustrated here as $[(u_id)_{200}, t_{200}, MT_{200}, PTT_{200}, DSP_{q\text{-}param\ 3}]$.

Figure 10:
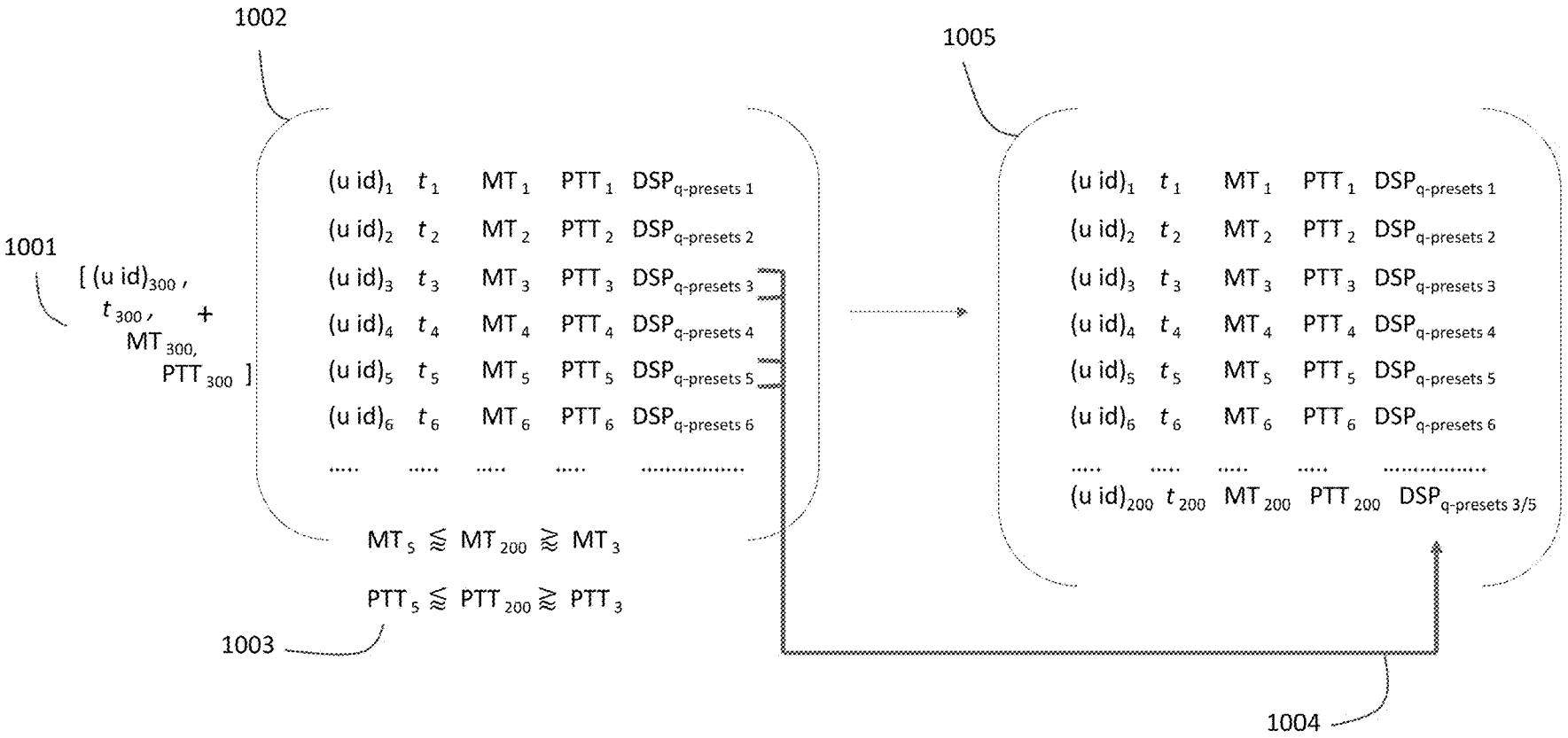
FIG. 10 illustrates a method for parameter calculation using an interpolation of nearest-fitting hearing data.

FIG. 10 illustrates an exemplary embodiment for indirectly calculating objective parameter sets for a given algorithm based on preexisting entries or anchor points. Here, server database entries 1002 are employed to interpolate 1004 between two nearest fits with user hearing data input 1001 $MT_{300}$ and $PT_{300}$ for $(u_id)_{300}$. In this example, the $(u_id)_{300}$ hearing data fits nearest between: $MT_5 \lesssim MT_{200} \gtrsim MT_3$ and $PTT_5 \lesssim PTT_{200} \gtrsim PTT_3$ 1003. To this extent, $(u_id)_3$ and $(u_id)_5$ parameter sets are interpolated to generate a new set of parameters for the $(u_id)_{300}$ parameter set entry, represented here as $[(u_id)_{200}, t_{200}, MT_{200}, PTT_{200}, DSP_{q\text{-}param3/5}]$ 1005. In a further embodiment, interpolation may be performed across multiple data entries to calculate sound enhancement parameters.

DSP parameter sets may be interpolated linearly, e.g., a DRC ratio value of 0.7 for user 5 $(u_id)_5$ and 0.8 for user 3 $(u_id)_3$ would be interpolated as 0.75 for user 200 $(u_id)_{200}$ in the example of FIG. 9 (and/or a user in the context of FIGS. 7A-C), assuming user 200's hearing data was halfway in-between that of users 3 and 5. In some embodiments, DSP parameter sets may also be interpolated non-linearly, for instance using a squared function, e.g. a DRC ratio value of 0.6 for user 5 and 0.8 for user 3 would be non-linearly interpolated as 0.75 for user 200 in the example of FIG. 9 (and/or a user in the context of FIGS. 7A-C).

The objective parameters are then outputted to a 2D fitting application, comprising a graphical user interface to determine user subjective preference. Subjective fitting is an iterative process. For example, returning to the discussion of FIG. 6, first, a user selects a grid point on the 2D grid interface 606 (the default starting point on the grid corresponds to the parameters determined from the prior objective fitting). The user then selects a new (x, y) point on the grid corresponding to different compression (y) and coloration (x) values. New parameters are then outputted 307 to a sound personalization DSP, whereby a sample audio file(s) 608 may then be processed according to the new parameters and outputted on a transducer of an audio output device 607 such that the user may readjust their selection on the 2D interface to explore the parameter setting space and find their preferred fitting. Once an initial selection is made, the interface may expand to enable the user to fine tune their fitting parameters. To this extent, the x- and y-axis values will narrow in range, e.g., from 0 to 1, to 0.5 to 0.6. Once the parameters are finalized, they may be stored 609, locally on the device or optionally, on a remote server.

Although reference is made to an example in which the y-axis corresponds to compression values and the x-axis corresponds to coloration values, it is noted that that is done for purposes of example and illustration and is not intended to be construed as limiting. For example, it is contemplated that the x and y-axes, as presented, may be reversed while maintaining the presentation of coloration and compression to a user; moreover, it is further contemplated that other sound and/or fitting parameters may be presented on the 2D fitting interface and otherwise utilized without departing from the scope of the present disclosure.

Figure 11:
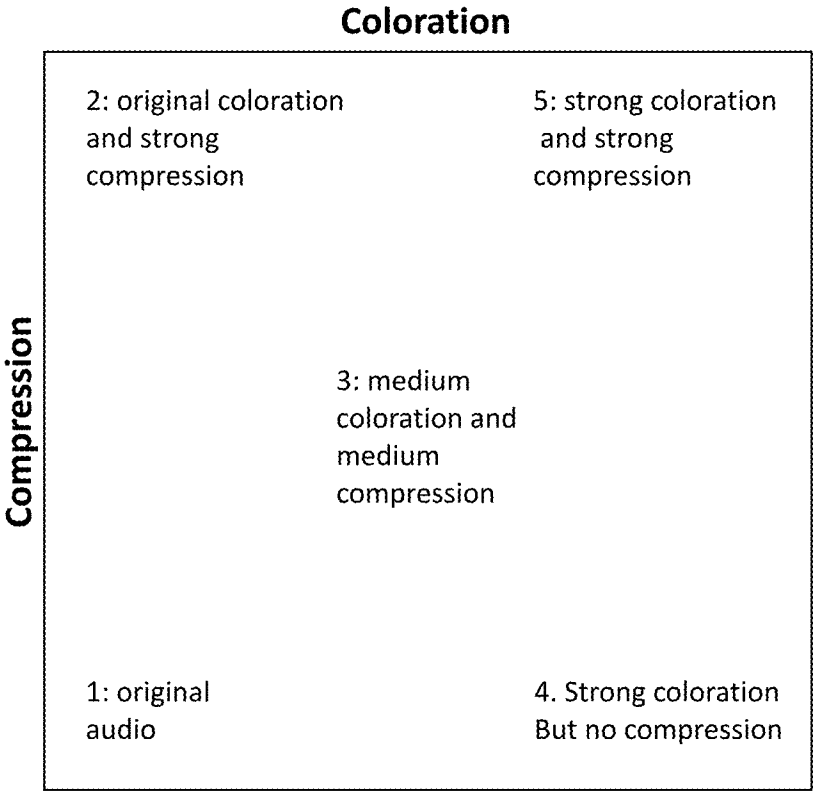
FIG. 11 illustrates an exemplary 2D-fitting interface showing the level of compression and coloration at a given point.

FIGS. 11 and 12 illustrate an exemplary 2D-fitting interface according to aspects of the present disclosure. More particularly, FIG. 11 depicts an example perceptual dimension space of an example 2D-fitting interface, in which compression is shown on the y-axis and coloration is shown on the x-axis. As illustrated, compression increases as the user moves up on the y-axis (e.g., from point 1 to point 2) while coloration increases as the user moves to the right on the x-axis (e.g., from point 1 to point 4). When a user moves along both the x-axis and the y-axis simultaneously, both compression and coloration will change simultaneously as well (e.g., from point 1 to 3 to 5). As noted previously, the use of coloration and compression on the x-y axes is provided for purposes of illustration, and it is appreciated that other user adjustable parameters for sound fitting and/or customization can be presented on the 2D-fitting interface without departing from the scope of the present disclosure.

In some embodiments, the 2D-fitting interface can be dynamically resized or refined, such that the perceptual dimension display space from which a user selection of (x, y) coordinates is made is scaled up or down in response to one or more factors. The dynamic resizing or refining of the 2D-fitting interface can be based on a most recently received user selection input, a series of recently received user selection inputs, a screen or display size where the 2D-fitting interface is presented, etc.

Figures 12A, 12B:
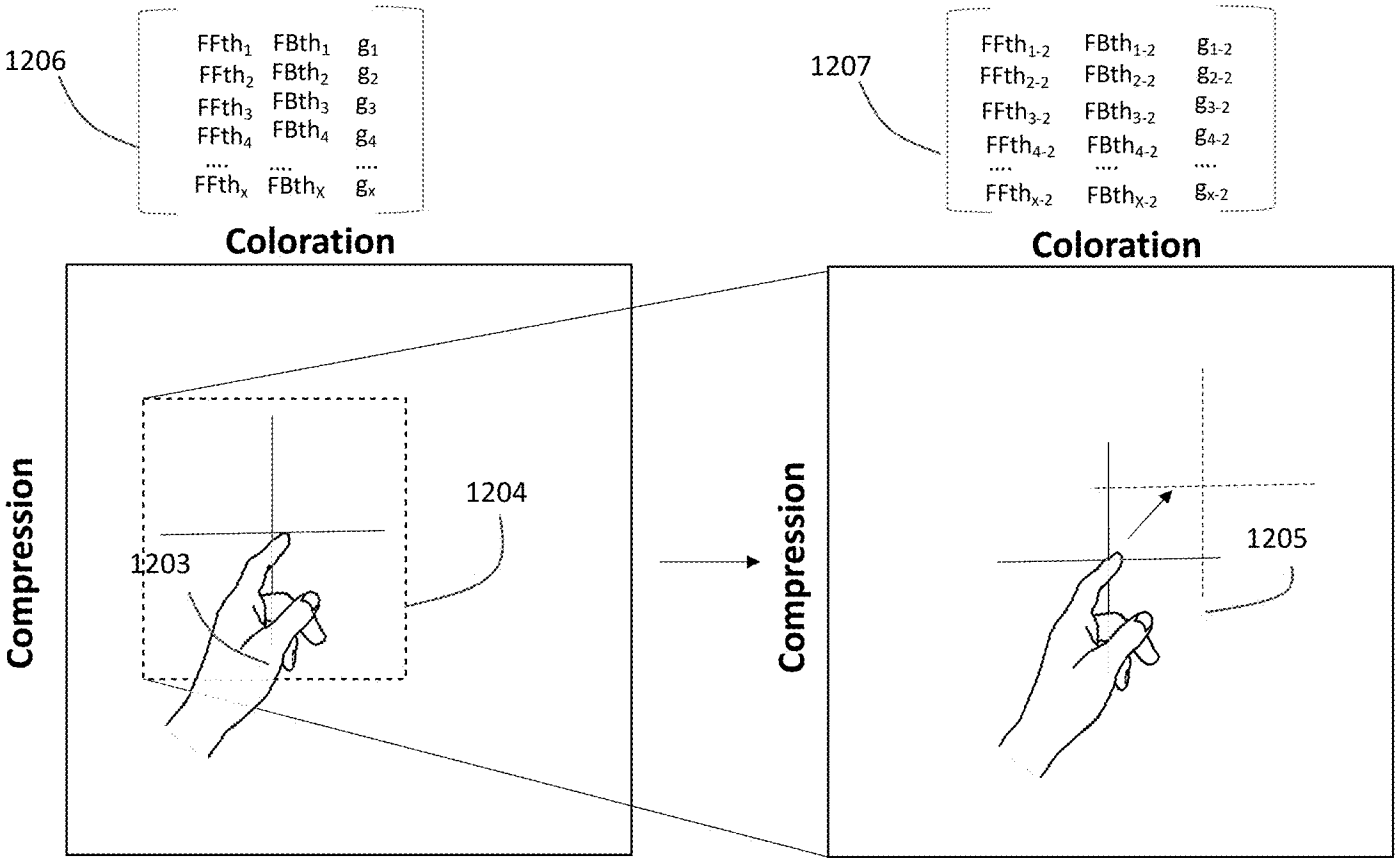
FIGS. 12A-B illustrates an exemplary 2D-fitting interface and corresponding sound customization parameters for initial and subsequent selection points on the 2D-fitting interface.

For example, turning to FIGS. 12A-B, shown is an example 2D-fitting process (with corresponding adjustments to sound customization parameters, i.e., coloration and compression parameters) depicted at an initial selection step seen in FIG. 12A and a subsequent selection step seen in FIG. 12B. In particular, with respect to the transition from the initial selection step of FIG. 12A to the subsequent selection step of FIG. 12B, illustrated is the corresponding change in sound customization parameters from 1206 to 1207, as well as the refinement of the x and y axis scaling—at the subsequent selection step of FIG. 12B, the axis scaling is refined to display only the sub-portion 1204 of the entirety of the field of view presented in the initial selection step of FIG. 12A. In other words, when the initial selection of FIG. 12A is made, the 2D-fitting interface may refine the axes so as to allow a more focused parameter selection. As seen in FIG. 12A, the smaller, dotted box 1204 represents the same field of view as the entirety of FIG. 12B, i.e., which is zoomed in on the field of view 1204 from FIG. 12A. As the 2D selection space expands, it allows the user to select a more precise parameter set 1207, in this instance, from point 1203 to point 1205. In some embodiments, the selection process may be iterative, such that a more successively 'zoomed' in parameter space is used.

The initial selection step of FIG. 12A (and/or subsequent selection step of FIG. 12B) can be made on a touchscreen or other 2D-fitting interface, wherein the initial selection step corresponds to at least a first selection point centered around an (x, y) coordinate 1203. After the axis scaling/refinement is made between the initial and subsequent selection steps, as discussed above, a user input indicates a new selection point 1205, centered around a different (x, y) coordinate than the first selection point. Based on at least the (x, y) coordinate values at each selection step, appropriate customization parameters 1206 and 1207 are calculated—as illustrated, the initial selection step results in customization parameters 1206, while the subsequent selection step results in customization parameters 1207.

Figure 13:
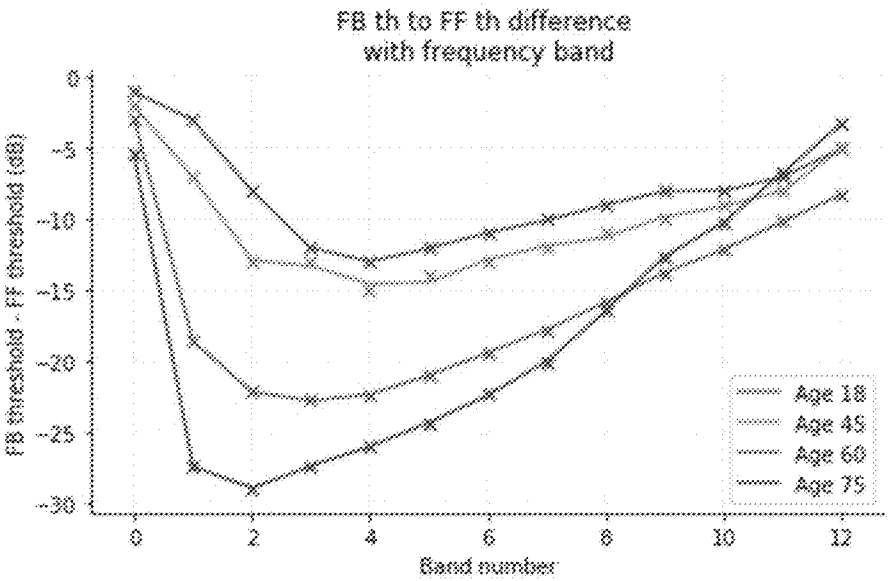
FIG. 13 illustrates example feedback and feedforward threshold differences determined from user testing for different age groups and band numbers.

Here, parameters 1206,1207 comprise a feed-forward threshold (FFth) value, a feed-back threshold (FBth) value, and a gain (g) value for each subband in the multiband dynamic processor that is subject to the 2D-fitting process of the present disclosure (e.g., such as the multiband dynamic process illustrated in FIGS. 4 and 5). As will be explained in greater depth below, the FFth and FBth values can both be adjusted based on the compression input determined from the (x, y) coordinate received at the 2D-fitting interface; likewise, the gain values can be adjusted, independent from FFth and FBth, based on the coloration input determined from the same (x, y) coordinate received at the 2D-fitting interface. More particularly, corresponding pairs of FFth and FBth values can be adjusted based on or relative to a pre-determined difference between the paired FFth and FBth values for a given subband, as is illustrated in FIG. 13 (e.g., $FFth_1$ and $FBth_1$ comprise a single pair of compression values from the initial customization parameters 1206; as the user changes their selected compression coordinate on the 2D interface, the values of $FFth_1$ and $FBth_1$ are scaled proportional to a pre-determined difference for subband 1. In some embodiments, different relationships and/or rates of changes can be assigned to govern adjustments to the compression and coloration parameters in each of the respective subbands of the multiband dynamic processor that is being adjusted in the 2D-fitting process.

Although changes in a selected (x, y) or (coloration, compression) coordinate made parallel to one of the two axes would seemingly affect only the value represented by that axis (i.e., changes on the y-axis would seemingly affect only coloration while leaving compression unchanged), the perceptual entanglement of coloration and compression means that neither value can be changed without causing a resultant change in the other value. In other words, when coloration and compression are entangled, neither perceptual dimension can be changed independently. For example, consider a scenario in which compression is increased by moving upwards, parallel to the y-axis. In response to this movement, compressiveness can be increased by lowering compression thresholds and making ratios harsher. However, depending on the content, these compression changes alone will often introduce coloration changes by changing the relative energy distribution of the audio, especially if the compression profile across frequency bands is not flat. Therefore, steady-state mathematical formulas are utilized to correct these effective level and coloration changes by adjusting gain parameters in such a way that the overall long-term frequency response for CE noise is not being altered. This way, a perceptual disentanglement of compressiveness to coloration is achieved in real time. FIGS. 13-15 illustrate this concept, using the same example output formula as previously referenced above:

$$O=[[(1-FF_r)\cdot FF_i+I\cdot FF_r+FB_i\cdot FB_c\cdot FF_r]/(1+FB_c\cdot FF_r)]+g.$$

Specifically, FIG. 13 illustrates an exemplary relationship between FF-threshold and FB-threshold values, broken down by user age and particular subband number. Here, the difference between the FF-threshold and the FB-threshold values for a given frequency band are established based on user testing data, i.e., where the user testing data is generated and analyzed in order to determine the particular $FF_{th}$ to $FB_{th}$ differential that provides an ideal hearing comprehension level (for a user of a given age, in a given subband) using the feedforward-feedback multiband dynamic processor illustrated in FIGS. 4-5. To this extent, as a user slides the selection coordinate up and down on the 2D-fitting interface, the $FF_{th}$ and $FB_{th}$ compressive values change simultaneously according to a given mathematical-relationship, such as the relationships outlined in the graph of FIG. 13. It is noted that the threshold differences depicted in FIG. 13 are provided for purposes of example of one particular set of 'ideal' threshold differences determined from a first testing process over a particular set of listeners; it is appreciated that various other threshold differences can be utilized without departing from the scope of the present disclosure. Furthermore, sliding left or right on the coloration axis would have a similar effect, changing gain levels for each frequency band based on a pre-defined gain change for each frequency band. To this extent, a user can explore a complex, perceptually-disentangled space while output is held constant—e.g., for a 13 band multiband dynamics processor with $FF_{th}$, $FB_{th}$, and gain values changing per subband, a total of 39 variables would change based upon moving on the x and y axes (13 bands*3 variables [$FF_{th}$, $FB_{th}$, g] per subband=39).

FIG. 14 illustrates this perceptual disentanglement, demonstrating how coloration (taken here as the relative gain changes between subbands) remains the same when a user moves vertically along the y-axis to adjust compression. In other words, FIG. 14 illustrates how coloration changes induced by direct user adjustments to compression are rectified by adjusting gain values to result in a substantially similar or identical coloration, despite the compression changes. Using the 2D-interface shown in FIG. 11, exemplary values are shown in the graphs for gain, FF-threshold and FB-threshold for two separate selections on the 2D-grid (FIG. 11): a top-right selection with values 1401, 1404 and 1406 (denoting strong coloration and strong compression) and a mid-right selection with values 1402, 1403 and 1405 (denoting strong coloration and mild compression). The final output is shown on the right in FIG. 14, with top-right 1407, mid-right 1408 and the original CE noise 1409. Note that in this final output graph, the traces of the resulting sound energy for selection 1407 and selection 1408 are nearly identical, confirming that compression-induced changes to coloration have been compensated for (because the energy distribution of each selection corresponds to coloration).

Figure 15B:
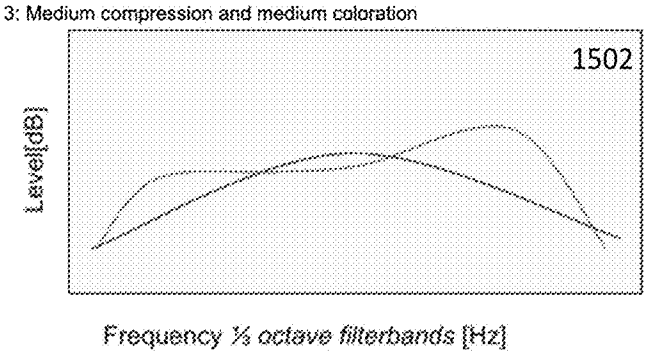
FIGS. 15A-C illustrate exemplary audio signals processed by three different fitting levels.
Figure 15C:
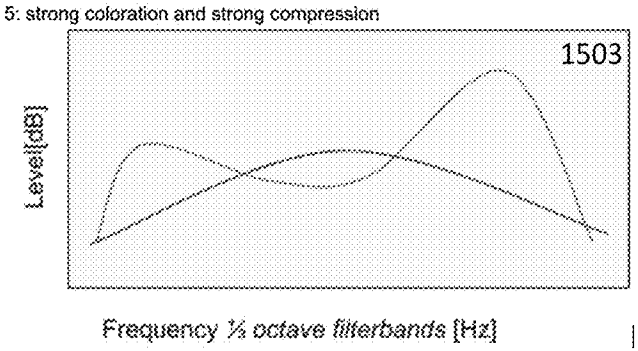
Figure 15A:
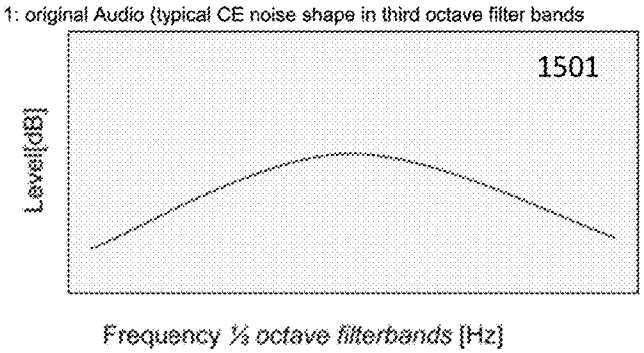

FIGS. 15A-C further illustrate three different parameter settings using a hypothetical, input CE noise shape in a third octave filter band, using the parameter relationships as describe in the above paragraph. FIG. 15A depicts this original input CE noise shape without the application of any additional compression or coloration. FIG. 15B illustrates the application of medium compression and medium coloration to the original input CE noise shape, resulting in an audio shape in which the mid peak of the noise is compressed, while gain is applied at the lower and upper frequencies of the noise band. Similarly, the effect is further exaggerated with the application of higher compression and higher coloration—FIG. 15C illustrates one such application of high compression and high coloration to the original input CE noise shape, resulting in an audio shape in which the effects seen in FIG. 15B/audio shape are more prominent.

Figure 16:
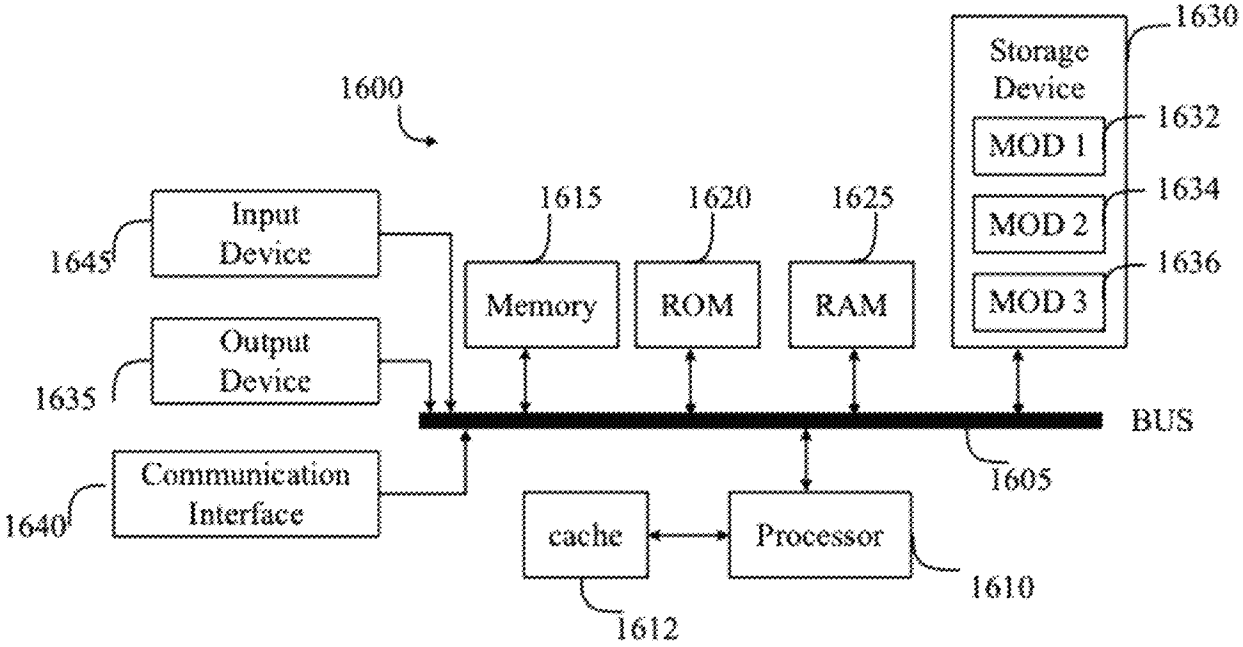
FIG. 16 illustrates an example system embodiment in which aspects of the present disclosure may be provided.

FIG. 16 shows an example of computing system 1600, which can be for example any computing device making up (e.g., mobile device 100, server, etc.) or any component thereof in which the components of the system are in communication with each other using connection 1405. Connection 1605 can be a physical connection via a bus, or a direct connection into processor 1610, such as in a chipset architecture. Connection 1605 can also be a virtual connection, networked connection, or logical connection.

In some embodiments computing system 1600 is a distributed system in which the functions described in this disclosure can be distributed within a datacenter, multiple datacenters, a peer network, etc. In some embodiments, one or more of the described system components represents many such components each performing some or all of the function for which the component is described. In some embodiments, the components can be physical or virtual devices.

Example system 1600 includes at least one processing unit (CPU or processor) 1610 and connection 1605 that couples various system components including system memory 1615, such as read only memory (ROM) 1620 and random-access memory (RAM) 1625 to processor 1610. Computing system 1600 can include a cache of high-speed memory 1612 connected directly with, in close proximity to, or integrated as part of processor 1610.

Processor 1610 can include any general-purpose processor and a hardware service or software service, such as services 1632, 1634, and 1636 stored in storage device 1630, configured to control processor 1610 as well as a special-purpose processor where software instructions are incorporated into the actual processor design. Processor 1610 may essentially be a completely self-contained computing system, containing multiple cores or processors, a bus, memory controller, cache, etc. A multi-core processor may be symmetric or asymmetric.

To enable user interaction, computing system 1600 includes an input device 1645, which can represent any number of input mechanisms, such as a microphone for speech, a touch-sensitive screen for gesture or graphical input, keyboard, mouse, motion input, speech, etc. Computing system 1600 can also include output device 1635, which can be one or more of a number of output mechanisms known to those of skill in the art. In some instances, multimodal systems can enable a user to provide multiple types of input/output to communicate with computing system 1600. Computing system 1600 can include communications interface 1640, which can generally govern and manage the user input and system output. There is no restriction on operating on any particular hardware arrangement and therefore the basic features here may easily be substituted for improved hardware or firmware arrangements as they are developed.

Storage device 1630 can be a non-volatile memory device and can be a hard disk or other types of computer readable media which can store data that are accessible by a computer, flash memory cards, solid state memory devices, digital versatile disks, cartridges, random access memories (RAMs), read only memory (ROM), and/or some combination of these devices.

The storage device 1630 can include software services, servers, services, etc., that when the code that defines such software is executed by the processor 1610, it causes the system to perform a function. In some embodiments, a hardware service that performs a particular function can include the software component stored in a computer-readable medium in connection with the necessary hardware components, such as processor 1610, connection 1605, output device 1635, etc., to carry out the function.

It should be further noted that the description and drawings merely illustrate the principles of the proposed device. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed device. Furthermore, all statements herein providing principles, aspects, and embodiments of the invention, as well as specific examples thereof, are intended to encompass equivalents thereof.

The invention claimed is:

1. A method for fitting a sound personalization algorithm using a two-dimensional (2D) graphical fitting interface, the method comprising:

generating a user hearing profile for a user;

determining, based on user hearing data from the user hearing profile, a calculated set of initial digital signal processing (DSP) parameters for a given sound personalization algorithm;

outputting the set of initial DSP parameters to a two-dimensional (2D) graphical fitting interface of an audio personalization application running on an audio output device, wherein:

the set of initial DSP parameters is obtained based on a unique identifier of the user; and the 2D graphical fitting interface comprises a first axis representing a level of coloration and a second axis representing a level of compression;

receiving at least a first user input to the 2D graphical fitting interface, specifying a first 2D coordinate selected from a coordinate space presented by the 2D graphical fitting interface;

generating, based on the first 2D coordinate, at least a first set of refined DSP parameters for the given sound personalization algorithm, wherein the first set of refined DSP parameters applies one or more of a coloration adjustment and a compression adjustment corresponding to the first 2D coordinate;

parameterizing the given sound personalization algorithm with the first set of refined DSP parameters; and outputting, to a transducer of the audio output device, at least one audio sample processed by the given sound personalization algorithm parameterized by the first set of refined DSP parameters.

2. The method of claim 1, further comprising iteratively determining a final set of refined DSP parameters based on successive user inputs specifying selections of 2D coordinates from the 2D graphical fitting interface.

3. The method of claim 2, further comprising:

receiving, in response to outputting the at least one audio sample processed by the given sound personalization algorithm parameterized by the first set of refined DSP parameters, a second user input to the 2D graphical fitting interface, wherein the second user input specifies a second 2D coordinate selected from the coordinate space presented by the 2D graphical fitting interface;

generating, based on the second 2D coordinate, a second set of refined DSP parameters for the given sound personalization algorithm, wherein the second set of refined DSP parameters applies one or more of a different coloration adjustment and a different compression adjustment than the first set of refined DSP parameters;

parameterizing the given sound personalization algorithm with the second set of refined DSP parameters; and outputting, to the transducer of the audio output device, the same at least one audio sample processed by the given sound personalization algorithm parameterized by the second set of refined DSP parameters.

4. The method of claim 3, wherein the second 2D coordinate is different from the first 2D coordinate.

5. The method of claim 3, wherein the 2D graphical fitting interface calculates a zoomed-in coordinate space prior to receiving the second user input specifying the second 2D coordinate, wherein the zoomed-in coordinate space is a subset of the coordinate space from which the first 2D coordinate was selected.

6. The method of claim 1, wherein parameterizing the given sound personalization algorithm with the first set of refined DSP parameters further comprises perceptually disentangling the coloration adjustment from the compression adjustment corresponding to the first 2D coordinate, such that the coloration adjustment is applied independently from the compression adjustment.

7. The method of claim 6, wherein:

the compression adjustment is calculated for each one of a plurality of subbands and comprises two interlinked threshold variables based on a pre-determined differential for each given subband; and the coloration adjustment is calculated for each one of the plurality of subbands and comprises a specific gain value for each given subband.

8. The method of claim 7, wherein the pre-determined differential for each given subband of the compression adjustment is further determined by an age of the user, such that the pre-determined differential represents an optimal difference between a feedback threshold and a feedforward threshold for the combination of the user's age and the given subband.

9. The method of claim 6, wherein the first set of refined DSP parameters comprises coloration adjustments and compression adjustments for each subband of a plurality of subbands associated with the DSP, such that, for a given subband:

the coloration adjustment comprises a gain value calculated for the given subband based at least in part on a coloration component of the first 2D coordinate; and the compression adjustment comprises a feedback threshold value and a feedforward threshold value, calculated based at least in part on a pre-determined ideal feedback-feedforward threshold difference and a compression component of the first 2D coordinate.

10. The method of claim 1, wherein the user hearing data from the user hearing profile comprises user demographic information.

11. The method of claim 10, wherein generating the user hearing profile comprises:

obtaining, using a first instance of an audio personalization application running on a first audio output device, an inputted user demographic information;

outputting, to a server, the user demographic information; and storing the user demographic information on a database associated with the server, wherein the user demographic information is stored using a unique identifier of the user as reference.

12. The method of claim 11, wherein:

the user hearing profile is stored on the database associated with the server; and the user hearing data, comprising the user demographic information, is associated with the user hearing profile via the unique identifier of the user.

13. The method of claim 2, wherein the final set of refined DSP parameters is used to parameterize the given sound personalization algorithm, such that the audio output device outputs audio files processed by the given sound personalization algorithm parameterized by the final set of DSP parameters.

14. The method of claim 7, wherein the hearing test is one or more of a threshold test, a suprathreshold test, a psychophysical tuning curve test, a masked threshold test, and a cross-frequency simultaneous masking test.

15. The method of claim 7, wherein the hearing test measures across a range of audible frequencies from 250 Hz to 8 kHz.

16. The method of claim 1, wherein the given sound personalization algorithm operates on sub-band signals of an input audio signal.

17. The method of claim 16, wherein the given sound personalization algorithm is a multiband dynamics processor.

18. The method of claim 17, wherein parameters of the multiband dynamics processor include at least one of a threshold value of a dynamic range compressor provided in each subband, a ratio value of a dynamic range compressor provided in each subband, and a gain value provided in each subband.

19. The method of claim 1, wherein the set of initial DSP parameters are calculated using a best fit of the user hearing data against previously inputted hearing data within a database, wherein a set of corresponding DSP parameters associated with a determined best fitting previously inputted hearing data are used as the calculated set of initial DSP parameters.

20. The method of claim 1, wherein the audio output device is one of a mobile phone, a tablet, a television, a laptop computer, a hearable device, a smart speaker, a headphone and a speaker system.

* * * * *